US008747733B2

(12) United States Patent
Oikawa et al.

(10) Patent No.: US 8,747,733 B2
(45) Date of Patent: Jun. 10, 2014

(54) PRECIPITATION HARDENABLE MARTENSITIC STAINLESS STEEL AND STEAM TURBINE BLADE USING THE SAME

(75) Inventors: Shinji Oikawa, Hitachi (JP); Hideo Yoda, Hitachi (JP); Masahiko Arai, Hitachinaka (JP); Hiroyuki Doi, Tokai (JP)

(73) Assignee: Hitachi, Ltd., Tokyo (JP)

( * ) Notice: Subject to any disclaimer, the term of this patent is extended or adjusted under 35 U.S.C. 154(b) by 660 days.

(21) Appl. No.: 13/086,416

(22) Filed: Apr. 14, 2011

(65) Prior Publication Data

US 2011/0255988 A1 Oct. 20, 2011

(30) Foreign Application Priority Data

Apr. 16, 2010 (JP) ..... 2010-094530

(51) Int. Cl.

| | |
|---|---|
| ***C22C 38/44*** | (2006.01) |
| ***C22C 38/46*** | (2006.01) |
| ***C22C 38/48*** | (2006.01) |
| ***C22C 38/50*** | (2006.01) |
| ***F01D 5/14*** | (2006.01) |

(52) U.S. Cl.

USPC ..... 420/63; 420/68; 420/69; 148/326; 416/241 R

(58) Field of Classification Search

CPC ..... C22C 38/44; C22C 38/46; C22C 3/48; C22C 38/50; F01D 5/14

USPC ..... 420/63, 68, 69; 148/325, 326; 416/241 R

See application file for complete search history.

(56) References Cited

U.S. PATENT DOCUMENTS

| | | | | |
|---|---|---|---|---|
| 2,999,039 | A * | 9/1961 | Lula et al. | 420/62 |
| 3,556,776 | A * | 1/1971 | Clark, Jr. et al. | 420/52 |
| 3,902,823 | A * | 9/1975 | Minato et al. | 416/186 R |
| 5,310,431 | A * | 5/1994 | Buck | 148/325 |

FOREIGN PATENT DOCUMENTS

| | | |
|---|---|---|
| EP | 0 646 653 | 4/1995 |
| EP | 1 669 473 | 6/2006 |
| JP | 2-310339 | 12/1990 |
| JP | 2000-161006 | 6/2000 |
| JP | 2005-171339 | 6/2005 |
| JP | 2005-194626 | 7/2005 |
| JP | 2005-232575 | 9/2005 |
| JP | 2008-127613 | 6/2008 |
| WO | WO 2006/068610 | 6/2006 |
| WO | WO 2007/067134 | 6/2007 |

OTHER PUBLICATIONS

EP Search Report of Appln. 11003254.7 dated Jul. 26, 2011 in English.

* cited by examiner

*Primary Examiner* — Deborah Yee

(74) *Attorney, Agent, or Firm* — Antonelli, Terry, Stout & Kraus, LLP.

(57) ABSTRACT

A precipitation hardenable martensitic stainless steel excellent in the stability of martensite, having the high strength, high toughness and high corrosion resistance is provided. The precipitation hardenable martensitic stainless steel contains at a mass rate, C: 0.05-0.10%, Cr: 12.0-13.0%, Ni: 6.0-7.0%, Mo: 1.0-2.0%, Si: 0.01-0.05%, Mn: 0.06-1.0%, Nb: 0.3-0.5%, V: 0.3-0.5%, Ti: 1.5-2.5%, Al: 1.0-2.3%, and the remainder consisting of Fe and an unavoidable impurity.

4 Claims, 2 Drawing Sheets

PRECIPITATION HARDENABLE MARTENSITIC STAINLESS STEEL AND STEAM TURBINE BLADE USING THE SAME

CROSS REFERENCE TO RELATED APPLICATIONS

This application claims the foreign priority benefit under Title 35, United State Code, 119 (a)-(d) of Japanese Patent Application No. 2010-094530, filed on Apr. 16, 2010 in the Japan Patent Office, the disclosure of which is herein incorporated by reference in its entirety.

BACKGROUND OF THE INVENTION

1. Field of the Invention

The present invention relates to a precipitation hardenable martensitic stainless steel and a steam turbine blade using the precipitation hardenable martensitic stainless steel.

2. Description of Related Art

A low pressure stage blade used for a steam turbine is demanded to be lengthened so as to enhance the efficiency of a power generation of a steam power generation plant using the blade. Further, high strength of the steam turbine blade is required from a viewpoint of securing the safety of the blade because the centrifugal force applied to the blade is increased as the length of the blade is increased.

A steam turbine blade using a 12 Cr (chromium) steel is known in a prior art (see, for example, Japanese Laid-Open Patent Publication No. 2000-161006). The 12 Cr steel having a high strength allows the steam turbine blade to have a high safety profile.

Meanwhile, in a steam turbine plant to be constructed abroad, of which export is expected to be expanded in future, it is assumed that the water quality used for the plant abroad is poorer than that used in Japan. Accordingly, the strength of the steam turbine blade used in the plant abroad is required to be highly increased and the corrosion resistance thereof is also required to be improved corresponding to the water quality used for the plant abroad. When considering such requirements, the above mentioned 12 Cr steel is not suitable for a material of the steam turbine blade used in the plant abroad because the corrosion resistance of the 12 Cr steel is insufficient.

In a prior art, a precipitation hardenable martensitic stainless steel is known as a material of the steam turbine blade (see, for example, Japanese Laid-Open Patent Publication Nos. 2005-194626, 2005-232575, and 2008-127613).

In general, in a precipitation hardenable martensitic stainless steel, a relatively large amount of Cr is added and an addition amount of C (carbon) having a harmful influence against the corrosion resistance is restricted. This allows the precipitation hardenable martensitic stainless steel to have an excellent corrosion resistance.

However, precipitation hardenable martensitic stainless steels disclosed in Japanese Laid-Open Patent Publication Nos. 2005-194626 and 2005-232575 have a high Cr equivalent calculated as a ferritic element, and are likely to form s-ferrite. Further, the precipitation hardenable martensitic stainless steel forming δ-ferrite has a lowered mechanical property such as tensile strength or toughness. Moreover, such a precipitation hardenable martensitic stainless steel has a high Ni equivalent calculated as an austenitic element, and is likely to form residual austenite. Accordingly, the precipitation hardenable martensitic stainless steels disclosed in Japanese Laid-Open Patent Publication Nos. 2005-194626 and 2005-232575 have a disadvantage that the stability of the martensite is insufficient.

Further, a precipitation hardenable martensitic stainless steel disclosed in Japanese Laid-Open Patent Publication No. 2008-127613 comprises multiple types of precipitates which contribute to the precipitation hardening in the martensite structure. However, although multiple types of precipitates are included in the precipitation hardenable martensitic stainless steel, the amounts of the precipitates are small, resulting in lacking the sufficient strength or toughness thereof.

SUMMARY OF THE INVENTION

Accordingly, an object of the present invention is to provide a precipitation hardenable martensitic stainless steel excellent in the stability of martensite, having the high strength, high toughness and high corrosion resistance, and a steam turbine blade using the precipitation hardenable martensitic stainless steel.

Here, a precipitation hardenable martensitic stainless steel of the present invention, by which the above mentioned disadvantages are solved, contains at amass rate, C: 0.05-0.10%, Cr: 12.0-13.0%, Ni: 6.0-7.0%, Mo: 1.0-2.0%, Si: 0.01-0.05%, Mn: 0.06-1.0%, Nb: 0.3-0.5%, V: 0.3-0.5%, Ti: 1.5-2.5%, Al: 1.0-2.3%, and the remainder consisting of Fe and an unavoidable impurity. Further, the precipitation hardenable martensitic stainless steel satisfies all conditions that a value of (a) defined in the equation below is in the range of 1.1 to 1.8, a value of (b) is in the range of 8.5 to 11.8, a value of (c) is 20.2 or less, and a value of (d) is 10.0 or less.

$$(a)=[\text{Nb }\%]+[\text{V }\%]+10\times[\text{C }\%]$$

$$(b)=[\text{Al }\%]+[\text{Ni }\%]+[\text{Ti }\%]$$

$$(c)=[\text{Cr }\%]+1.5\times[\text{Si }\%]+[\text{Mo }\%]+0.5\times[\text{Nb }\%]+2\times[\text{Ti }\%]$$

$$(d)=[\text{Ni }\%]+0.5\times[\text{Mn }\%]+30\times[\text{C }\%]$$

Further, a steam turbine blade of the present invention, by which the above mentioned disadvantages are solved, is formed by the precipitation hardenable martensitic stainless steel containing at a mass rate, C: 0.05-0.10%, Cr: 12.0-13.0%, Ni: 6.0-7.0%, Mo: 1.0-2.0%, Si: 0.01-0.05%, Mn: 0.06-1.0%, Nb: 0.3-0.5%, V: 0.3-0.5%, Ti: 1.5-2.5%, Al: 1.0-2.3%, and the remainder consisting of Fe and an unavoidable impurity. Further, the precipitation hardenable martensitic stainless steel satisfies all conditions that a value of (a) defined in the equation below is in the range of 1.1 to 1.8, a value of (b) is in the range of 8.5 to 11.8, a value of (c) is 20.2 or less, and a value of (d) is 10.0 or less.

$$(a)=[\text{Nb }\%]+[\text{V }\%]+10\times[\text{C }\%]$$

$$(b)=[\text{Al }\%]+[\text{Ni }\%]+[\text{Ti }\%]$$

$$(c)=[\text{Cr }\%]+1.5\times[\text{Si }\%]+[\text{Mo }\%]+0.5\times[\text{Nb }\%]+2\times[\text{Ti }\%]$$

$$(d)=[\text{Ni }\%]+0.5\times[\text{Mn }\%]+30\times[\text{C }\%]$$

According to the present invention, a precipitation hardenable martensitic stainless steel excellent in the stability of the martensite structure, having the high strength, high toughness and high corrosion resistance thereof can be provided. Further, a steam turbine blade using the precipitation hardenable martensitic stainless steel can be provided.

BRIEF DESCRIPTION OF THE DRAWINGS

In FIG. 2, the defined range of the chemical composition of the present invention is shown by comparing to the evaluation results in Conventional Examples.

DETAILED DESCRIPTION OF THE PREFERRED EMBODIMENT

Next, an embodiment of the present invention will be explained in reference to the attached drawings. First, a steam turbine blade of the embodiment will be explained. Then, a precipitation hardenable martensitic stainless steel by which the steam turbine blade is formed will be explained.

(Steam Turbine Blade)

Figure 1A:
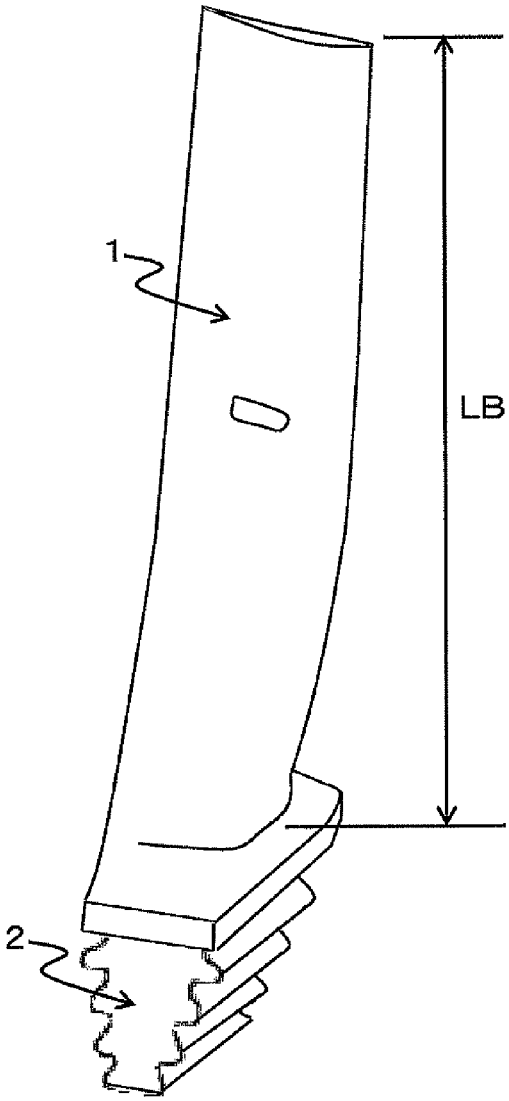
FIG. 1A is a perspective view of a fork-type steam turbine blade in an embodiment of the present invention.
Figure 1B:
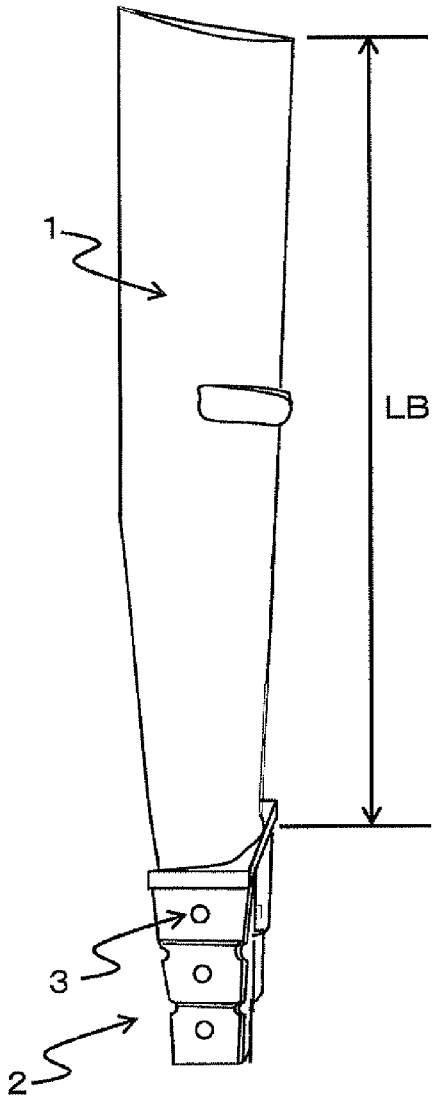
FIG. 1B is a perspective view of an axial-type steam turbine blade in an embodiment of the present invention.

As shown in FIGS. 1A and 1B, a steam turbine blade (10) of the present embodiment comprises a blade portion 1 on which the steam fits, an implanting portion 2 arranged at an implanting side of the blade portion 1 to attach the blade portion 1 as embedded in a rotor shaft (not shown).

The steam turbine blade 10 shown in FIG. 1A is an axial entry-type blade, so that the implanting portion 2 is formed in an inverse Christmas tree shape. The steam turbine blade 10 shown in FIG. 1B is a fork-type blade, so that the implanting portion 2 is formed in a fork shape.

Note the reference No. 3 in FIG. 1B indicates a pin inserting hole arranged at the implanting portion 2 so as to insert a pin for fixing the blade 10 to the rotor shaft (not shown).

Each of the steam turbine blades 10 shown in FIGS. 1A and 1B is a final stage blade of a low pressure steam turbine. A length LB of the blade portion 1 of the steam turbine blade 10 is 45 inch (1.14 m) or more for a rotational speed of 3600 rpm (60 Hz), and is 50 inch (1.27 m) or more for a rotational speed of 3000 rpm (50 Hz).

The above mentioned steam turbine blades 10 of the present embodiment are formed of the precipitation hardenable martensitic stainless steel of the present embodiment, which is described hereinafter.

(Precipitation Hardenable Martensitic Stainless Steel)

A precipitation hardenable martensitic stainless steel of the present embodiment contains, at the mass rate described hereinafter, C (carbon), Cr (chromium), Ni (nickel), Mo (molybdenum), Si (silicone), Mn (manganese), Nb (niobium), V (vanadium), Ti (titanium), Al (aluminum), and the remainder consisting of Fe (iron) and an unavoidable impurity.

An addition amount of C is needed to be set in the range of 0.05-0.08%, preferably 0.06-0.07%, and more preferably 0.062-0.068%.

The addition amount of C in 0.05% or more may suppress the formation of δ-ferrite, and contribute to the precipitation hardening in the precipitation hardenable martensitic stainless steel by compounds formed with Nb and V (or carbides). Further, the addition amount of C in 0.08% or less may suppress the precipitation of residual austenite.

An addition amount of Cr is needed to be set in the range of 12.0-13.0%, preferably 12.2-12.8%, and more preferably 12.4-12.6%.

The addition amount of Cr in 12.0% or more may improve the corrosion resistance of the precipitation hardenable martensitic stainless steel. Further, the addition amount of Cr in 13.0% or less may suppress the formation of δ-ferrite.

An addition amount of Ni is needed to be set in the range of 6.0-7.0%, preferably 6.2-6.8%, and more preferably 6.4-6.6%.

The addition amount of Ni in 6.0% or more may suppress the formation of δ-ferrite, and contribute to the precipitation hardening in the precipitation hardenable martensitic stainless steel by inter-metallic compounds formed with Al and Ti. Further, the addition amount of Ni in 7.0% or less may suppress the precipitation of residual austenite.

An addition amount of Mo is needed to be set in the range of 1.0-2.0%, preferably 1.2-1.8%, and more preferably 1.4-1.6%.

The addition amount of Mo in 1.0% or more may improve the corrosion resistance of the precipitation hardenable martensitic stainless steel, and further may contribute to the solid solution hardening and the precipitation hardening in the precipitation hardenable martensitic stainless steel. Further, the addition amount of Mo in 2.0% or less may suppress the formation of δ-ferrite.

An addition amount of Si is needed to be set in the range of 0.01-0.05%, preferably 0.02-0.04%, and more preferably 0.025-0.035%.

The addition amount of Si in 0.01% or more may functionalize Si as a deoxidizer. Further, the addition amount of Si in 0.05% or less may suppress the formation of δ-ferrite.

An addition amount of Mn is needed to be set in the range of 0.06-1.0%, preferably 0.2-0.8%, and more preferably 0.4-0.6%.

The addition amount of Mn in 0.06% or more may suppress the formation of δ-ferrite. Further, the addition amount of Mn in 1.0% or less may suppress the precipitation of residual austenite.

An addition amount of Nb is needed to be set in the range of 0.3-0.5%, preferably 0.35-0.45%, and more preferably 0.38-0.42%.

The addition amount of Nb in 0.3% or more may contribute to the precipitation hardening in the precipitation hardenable martensitic stainless steel by a compound with C (or carbide). Further, the addition amount of Nb in 0.5% or less may suppress the formation of δ-ferrite.

An addition amount of V is needed to be set in the range of 0.3-0.5%, preferably 0.35-0.45%, and more preferably 0.38-0.42%.

The addition amount of V in 0.3% or more may contribute to the precipitation hardening in the precipitation hardenable martensitic stainless steel by a compound with C (or carbide). Further, the addition amount of V in 0.5% or less may suppress the formation of δ-ferrite.

An addition amount of Ti is needed to be set in the range of 1.5-2.5%, preferably 1.7-2.3%, and more preferably 1.9-2.1%.

The addition amount of Ti in 1.5% or more may contribute to the precipitation hardening in the precipitation hardenable martensitic stainless steel by an inter-metallic compound with Ni. Further, the addition amount of Ti in 2.5% or less may allow the precipitation hardenable martensitic stainless steel to have the excellent toughness thereof.

An addition amount of Al is needed to be set in the range of 1.0-2.3%, preferably 1.2-2.0%, and more preferably 1.4-1.8%.

The addition amount of Al in 1.0% or more may contribute to the precipitation hardening in the precipitation hardenable martensitic stainless steel. Further, the addition amount of Al in 2.3% or less may suppress the excess precipitation of the inter-metallic compound, allowing the precipitation hardenable martensitic stainless steel to have an excellent hot forging property. Moreover, the addition amount of Al in 2.3% or less may suppress the formation of δ-ferrite.

The precipitation hardenable martensitic stainless steel of the present embodiment contains Fe and an unavoidable impurity as the remainder, besides the above mentioned metallic elements. Herein, since Fe is a base component of a stainless steel, which is well known, the detailed explanation will be omitted here.

Herein, the above mentioned unavoidable impurity is an impurity contained in a raw material or an impurity contaminated in a manufacturing process or the like, and is not added intentionally. A specific example of the unavoidable impurity includes P (phosphor), S (sulfur), Sb (antimony), Sn (tin), and As (arsenic). Among the above mentioned impurities, at least one kind of the impurity is included in the precipitation hardenable martensitic stainless steel of the present embodiment.

Preferably, the content of As is 0.1% or less, the content of Sb is 0.01% or less, and the content of Sn is 0.05% or less. More preferably, the content of As is 0.01% or less, the content of Sb is 0.001% or less, and the content of Sn is 0.005% or less.

By decreasing the contents of As, Sb and Sn respectively to fall in the above mentioned range, the toughness of the precipitation hardenable martensitic stainless steel at a low temperature may be more improved.

Preferably, the content of P is 0.015% or less, and the content of S is 0.015% or less. More preferably, the content of P is 0.01% or less, and the content of S is 0.01% or less.

By decreasing the contents of P and S to fall in the above mentioned range respectively, the toughness of the precipitation hardenable martensitic stainless steel at a low temperature may be improved without decreasing the tensile strength thereof.

Further, the precipitation hardenable martensitic stainless steel of the present invention needs to satisfy the following equations of (a) to (d) which define the relationship of the above mentioned addition amounts of the elements comprising C, Cr, Ni, Mo, Si, Mn, Nb, V, Ti and Al.

$$(a)=[\text{Nb }\%]+[\text{V }\%]+10\times[\text{C }\%]$$

$$(b)=[\text{Al }\%]+[\text{Ni }\%]+[\text{Ti }\%]$$

$$(c)=[\text{Cr }\%]+1.5\times[\text{Si }\%]+[\text{Mo }\%]+0.5\times[\text{Nb }\%]+2\times[\text{Ti }\%]$$

$$(d)=[\text{Ni }\%]+0.5\times[\text{Mn }\%]+30\times[\text{C }\%]$$

where a value of (a) is in the range of 1.1-1.8, a value of (b) is in the range of 8.5-11.8, a value of (c) is 20.2 or less, and a value of (d) is 10.0 or less.

Herein, (a) is an equation defining the contents of the carbides of the precipitations in the precipitation hardenable martensitic stainless steel. Note the respective abilities of Nb and V to form the carbide is superior to that of Cr. Hereby, the carbides of Nb and V are more preferentially formed than the carbide of Cr.

Accordingly, by setting the value of (a) to 1.1 or more, the precipitation hardening of the precipitation hardenable martensitic stainless steel given by the carbides can be improved without deteriorating the corrosion resistance thereof. Further, by setting the value of (a) to 1.8 or less, the stability of the martensite structure thereof can be improved.

Further, (b) is an equation defining the contents of the inter-metallic compounds of the precipitations in the precipitation hardenable martensitic stainless steel. Herein, Ti, Al, and Ni form the inter-metallic compounds, which contribute to the precipitation hardening of the precipitation hardenable martensitic stainless steel.

Accordingly, by setting the value of (b) to 8.5 or more, the precipitation hardening of the precipitation hardenable martensitic stainless steel can be achieved sufficiently. Further, by setting the value of (b) to 11.8 or less, the stability of the martensite structure can be improved.

Further, (c) is an equation defining the content of δ-ferrite in the metallic structure of the precipitation hardenable martensitic stainless steel.

Accordingly, by setting the value of (c) to 20.2 or less, the precipitation of δ-ferrite can be suppressed.

Further, (d) is an equation defining the content of residual austenite in the metallic structure of the precipitation hardenable martensitic stainless steel.

Accordingly, by setting the value of (d) to 10.0 or less, the precipitation of residual austenite can be suppressed.

Figure 2:
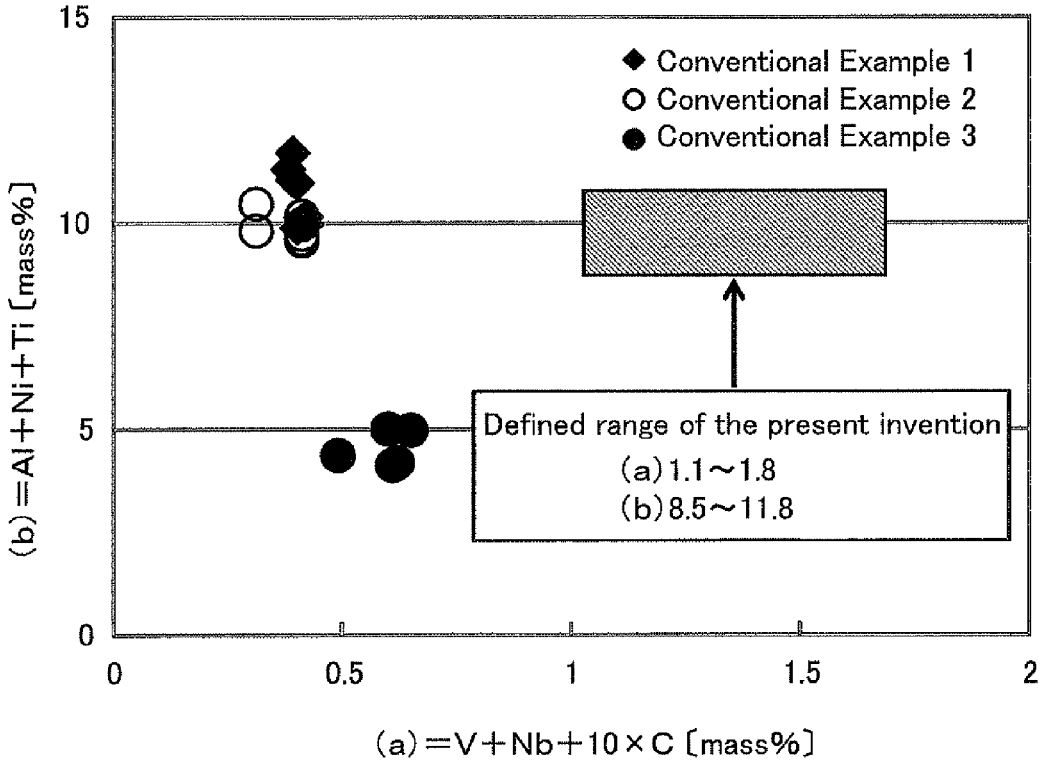
FIG. 2 is a graphic diagram showing a defined range of the chemical composition of the precipitation hardenable martensitic stainless steel of the present invention.

FIG. 2 is a graphic diagram showing a restricted range of the values in the equations of (a) and (b) defining the chemical composition of the precipitation hardenable martensitic stainless steel. In FIG. 2, the restricted range (or defined range) is shown by comparing to the evaluation results in Conventional Examples.

Herein, in FIG. 2, the stainless steels in Conventional Examples 1 to 3 correspond to the precipitation hardenable martensitic stainless steels described in Japanese Laid-Open Patent Publication Nos. 2005-194626, 2005-232575 and 2008-127613, respectively.

Next, a method of a thermal treatment for the precipitation hardenable martensitic stainless steel of the present invention will be described.

The method of the thermal treatment comprises steps of a quench treatment conducting a solution treatment of a precipitation hardenable martensitic stainless steel, a primary tempering treatment for tempering the product obtained after the quench treatment, and a secondary tempering treatment for tempering the product obtained after cooling the tempered product to room temperature.

The solution treatment is a thermal treatment for dissolving the precipitate in the fundamental metal.

The quench treatment for performing the solution treatment is conducted by heating the precipitation hardenable martensitic stainless steel at 910-950° C., preferably at 930-940° C., for 0.5-3.0 hr, preferably for 1.0-2.0 hr. Then, the heated product is rapidly cooled by immersing it in water at room temperature. By conducting the quench treatment, the metallic structure completely becomes the austenite structure.

The primary tempering treatment is conducted by heating the precipitation hardenable martensitic stainless steel after the quench treatment, at 550-580° C., preferably at 560-570° C., for 1.0-6.0 hr, preferably for 2.0-4.0 hr. Then, the heated product is cooled to room temperature in the air.

The secondary tempering treatment is conducted as follows. The precipitation hardenable martensitic stainless steel obtained after the primary tempering treatment is cooled to room temperature. Then, the cooled product is heated at 560-600° C., preferably at 570-590° C., for 1.0-6.0 hr, preferably for 2.0-4.0 hr. Then, the heated product is cooled to room temperature in the air. Herein, the heated temperature in the secondary tempering treatment is set to be higher than that in the primary tempering treatment.

By conducting the above mentioned thermal treatment, the above mentioned carbides and the inter-metallic compounds are finely precipitated in the metallic structure. Further, the residual austenite in the metallic structure is decomposed and the metallic structure becomes the tempered martensite. Accordingly, by conducting the thermal treatment, it is possible to obtain a precipitation hardenable martensitic stainless steel having a homogeneous metallic structure and increased strength and corrosion resistance at a high level.

As mentioned above, the precipitation hardenable martensitic stainless steel of the present embodiment is excellent in the stability of the martensite structure, having the excellent strength, toughness and corrosion resistance because the amounts of the precipitates of δ-ferrite and residual austenite are small.

More specifically, the precipitation hardenable martensitic stainless steel contains the amounts of the precipitates of δ-ferrite and residual austenite each in 1.0% or less, and has the tensile strength of 1350 MPa or more at room temperature, the Charpy value of 50 J/cm$^2$ or more at room temperature, and the pitting potential of 220 mV or more.

Further, the steam turbine blade of the present embodiment, which is formed by the above mentioned precipitation hardenable martensitic stainless steel, is excellent in the stability of the martensite, and has the excellent strength, toughness and corrosion resistance. Accordingly, the steam turbine blade of the present embodiment can be preferably used for a steam turbine blade in a domestic steam power generation plant and a steam power generation plant abroad where a high level of the water quality is required. Particularly, the steam turbine blade of the present embodiment can be used for a final stage blade of a low pressure steam turbine.

More specifically, the final stage blade of the low pressure steam turbine can be constructed so that the length of the blade (LB) shown in FIG. 1A or FIG. 1B, is 45 inch (1.14 m) or more for a rotational speed of 3600 rpm (60 Hz), and 50 inch (1.27 m) or more for a rotational speed of 3000 rpm (50 Hz).

Hereinbefore, the embodiment of the present invention has been described. However, the present invention is not limited to the embodiment and a variety of other embodiments can be used.

In the precipitation hardenable martensitic stainless steel of the above mentioned embodiment, a part of Mo can be substituted with W.

Further, in the precipitation hardenable martensitic stainless steel of the embodiment, apart of Nb can be substituted with Ta.

Moreover, in the precipitation hardenable martensitic stainless steel of the embodiment, a part of V can be substituted with Ta.

EXAMPLE

Next, the present invention will be described more specifically in reference to examples.

Examples 1 to 5

In Examples 1 to 5, precipitation hardenable martensitic stainless steels were produced, each having the chemical composition shown in Table 1, and the values in the equations of (a) to (d) (shown as "defined value" in Table 1). Here, "Fe etc." in Table 1 means that the remainder of the composition (described as Bal. in Table 1) consists of Fe and an avoidable impurity. Further, the precipitation hardenable martensitic stainless steel in the present embodiment may contain at least one kind of elements selected from P, S, Sb, and As as an unavoidable impurity, under the limit of determination.

TABLE 1

| | | Chemical Composition (mass %) | | | | | | | | | | | | Defined Value | | | |
|---|---|---|---|---|---|---|---|---|---|---|---|---|---|---|---|---|---|
| | | C | Cr | Ni | Mo | Si | Mn | Nb | V | Ti | Al | N | Fe etc. | (a) | (b) | (c) | (d) |
| Example | 1 | 0.05 | 12.51 | 6.04 | 1.48 | 0.01 | 0.34 | 0.3 | 0.31 | 1.53 | 1.09 | — | Bal. | 1.11 | 8.66 | 17.21 | 7.71 |
| | 2 | 0.05 | 12.52 | 6.82 | 1.46 | 0.02 | 0.22 | 0.3 | 0.32 | 2.43 | 2.20 | — | Bal. | 1.12 | 11.45 | 19.02 | 8.43 |
| | 3 | 0.08 | 12.54 | 6.13 | 1.51 | 0.01 | 0.23 | 0.48 | 0.49 | 1.67 | 1.11 | — | Bal. | 1.77 | 8.91 | 17.64 | 8.64 |
| | 4 | 0.08 | 12.52 | 6.98 | 1.52 | 0.01 | 0.25 | 0.48 | 0.48 | 2.42 | 2.12 | — | Bal. | 1.76 | 11.52 | 19.13 | 9.50 |
| | 5 | 0.07 | 12.54 | 6.60 | 1.51 | 0.01 | 0.24 | 0.41 | 0.42 | 2.03 | 1.61 | — | Bal. | 1.53 | 10.24 | 18.33 | 8.82 |
| Comparative Example | 1 | 0.05 | 12.53 | 6.55 | 1.48 | 0.01 | 0.31 | 0.11 | 0.13 | 1.98 | 1.58 | — | Bal. | 0.74 | 10.11 | 18.04 | 8.20 |
| | 2 | 0.07 | 12.55 | 6.58 | 1.48 | 0.01 | 0.32 | 0.81 | 0.78 | 2.01 | 1.58 | — | Bal. | 2.29 | 10.17 | 18.47 | 8.84 |
| | 3 | 0.05 | 12.52 | 5.02 | 1.46 | 0.01 | 0.33 | 0.31 | 0.32 | 1.02 | 0.49 | — | Bal. | 1.13 | 6.53 | 18.11 | 4.68 |
| | 4 | 0.05 | 12.49 | 8.06 | 1.49 | 0.01 | 0.31 | 0.32 | 0.32 | 3.02 | 1.51 | — | Bal. | 1.14 | 12.59 | 20.19 | 9.71 |
| | 5 | 0.05 | 14.02 | 6.52 | 1.46 | 0.02 | 0.34 | 0.41 | 0.42 | 3.03 | 1.52 | — | Bal. | 1.33 | 11.07 | 21.77 | 8.19 |
| | 6 | 0.11 | 12.44 | 7.02 | 1.52 | 0.01 | 0.26 | 0.31 | 0.32 | 2.03 | 1.59 | — | Bal. | 1.73 | 10.64 | 18.19 | 10.45 |
| | 7 | 0.05 | 9.95 | 6.49 | 1.48 | 0.01 | 0.32 | 0.41 | 0.41 | 1.99 | 1.59 | — | Bal. | 1.32 | 10.07 | 15.63 | 8.15 |
| | 8 | 0.05 | 12.46 | 6.48 | 0.51 | 0.01 | 0.32 | 0.41 | 0.41 | 2.02 | 1.59 | — | Bal. | 1.32 | 10.09 | 17.23 | 8.14 |
| | 9 | 0.05 | 12.52 | 6.49 | 3.53 | 0.01 | 0.24 | 0.40 | 0.40 | 2.03 | 1.60 | — | Bal. | 1.30 | 10.12 | 20.32 | 8.11 |
| Reference Example | 1 | 0.14 | 11.40 | 2.70 | 2.10 | 0.04 | 0.16 | 0.08 | 0.26 | — | — | 0.06 | Bal. | 1.74 | 2.70 | 13.60 | 6.98 |
| | 2 | 0.03 | 12.34 | 8.47 | 2.15 | 0.07 | 0.04 | 0.01 | — | — | 1.10 | — | Bal. | 0.31 | 9.57 | 14.60 | 9.39 |
| | 3 | 0.03 | 15.39 | 4.37 | 1.05 | 0.38 | 0.49 | 0.19 | — | — | — | 0.06 | Bal. | 0.49 | 4.37 | 17.10 | 5.51 |
| | 4 | 0.02 | 11.68 | 8.86 | 1.10 | 0.10 | 0.10 | 0.23 | — | 1.04 | — | — | Bal. | 0.43 | 9.90 | 15.12 | 9.51 |

(a) = [Nb %] + [V %] + 10 × [C %]: 1.1-1.8
(b) = [Al %] + [Ni %] + [Ti %]: 8.5-11.8
(c) = [Cr %] + 1.5 × [Si %] + [Mo %] + 0.5 × [Nb %] + 2 × [Ti %]: 20.2 or less
(d) = [Ni %] + 0.5 × [Mn %] + 30 × [C %]: 10.0 or less Each of the sample materials in Examples 1 to 5 contained the respective components in the chemical composition with the defined values shown in Table 1. The sample materials were produced by a high-frequency vacuum melting furnace using a high-frequency electric power under a high vacuum condition of $5.0\times10^{-3}$ Pa or less, thereby to be heated at 1600° C. or more by the rapid inductive heating of the high-frequency electric power. Next, these sample materials were formed in a rectangular shape with "t" 30 mm×"w" 90 mm×"L" 1000 mm, through the hot forging in which the sample materials were forged at the temperature in the range of 850-1150° C.

Next, each sample material was treated in the thermal treatment. The thermal treatment was conducted in the following steps. First, a solution treatment (referred to quench treatment) was conducted by heating each sample material at 930° C. for 1.5 hr using a box oven, then rapidly cooling by immersing the sample material in water at room temperature. Next, a primary tempering treatment was conducted, by heating the sample material at 560° C. for 3.0 hr, then gradually cooling it in the air at room temperature. Finally, a secondary tempering treatment was conducted, by heating each sample material at 580° C. for 3.0 hr, then gradually cooling it in the air at room temperature.

Next, for each sample material, the amounts of δ-ferrite and residual austenite, the tensile strength (MPa), the Charpy value (J/cm$^2$), and the pitting potential (mV) were measured.

The amounts of δ-ferrite and residual austenite were measured by evaluating the respective rates of δ-ferrite and residual austenite in the metallic structure. The evaluation was performed based on the JIS G0555 method.

For measuring the tensile strength, a test sample with a diameter of 6.0 mm and a length of 30 mm at the parallel portion was prepared. Then, the tensile strength of the test sample was measured at room temperature. Herein, the room temperature is in the range of 23±5° C.

For measuring the Charpy value, a V-notch test sample with 2 mm was prepared and the Charpy value was measured at room temperature.

Herein, note that the tensile strength and the Charpy value of the test sample were measured at room temperature. This is because the steam temperature in the final stage of the low pressure steam turbine was 100° C. or less.

For measuring the pitting potential, a test sample was formed with a thermally treated material into a 10 mm square shape. Then, using the test sample, the pitting potential was measured in the following conditions: a test solution of 3.0% NaCl solution, a test solution temperature at 30° C., and a sweep rate of 20 mV/min.

In the δ-ferrite and residual austenite evaluation, when each precipitation amount of δ-ferrite and residual austenite was 1.0% or less, it was evaluated as "good", while when each precipitation amount was above 1.0%, it was evaluated as "poor".

In the tensile strength evaluation, when the tensile strength was 1350 MPa or more, it was evaluated as "good", while when the tensile strength was less than 1350 MPa, it was evaluated as "poor".

In the Charpy value evaluation, when the Charpy value was 50 J/cm$^2$ or more, it was evaluated as "good", while when the Charpy value was less than 50 J/cm$^2$, it was evaluated as "poor".

In the pitting potential evaluation, when the pitting potential was 220 mV or more, it was evaluated as "good", while when the pitting potential was less than 220 mV, it was evaluated as "poor".

These evaluation results were summarized in Table 2.

TABLE 2

| | | δ-Ferrite and Residual Austinite | Tensile Strength | Charpy Value | Pitting Potential | Total Evaluation |
|---|---|---|---|---|---|---|
| Example | 1 | good | good | good | good | good |
| | 2 | good | good | good | good | good |
| | 3 | good | good | good | good | good |
| | 4 | good | good | good | good | good |
| | 5 | good | good | good | good | good |
| Comparative Example | 1 | good | poor | good | good | poor |
| | 2 | good | good | poor | good | poor |
| | 3 | good | poor | good | good | poor |
| | 4 | good | good | poor | good | poor |
| | 5 | poor | good | good | poor | poor |
| | 6 | poor | good | good | good | poor |

TABLE 2-continued

| | | δ-Ferrite and Residual Austinite | Tensile Strength | Charpy Value | Pitting Potential | Total Evaluation |
|---|---|---|---|---|---|---|
| | 7 | good | good | good | poor | poor |
| | 8 | good | good | good | poor | poor |
| | 9 | poor | poor | poor | good | poor |
| Reference Example | 1 | good | poor | good | poor | poor |
| | 2 | good | good | good | poor | poor |
| | 3 | good | poor | good | good | poor |
| | 4 | good | poor | good | poor | poor |

Here, in Table 2, when all items of the δ-ferrite and residual austenite, the tensile strength, the Charpy value, and the pitting potential were evaluated as "good", the total evaluation was indicated as "good", while when anyone of the items was evaluated as "poor", the total evaluation was indicated as "poor".

Comparative Examples 1-9

In Comparative Examples 1-9, precipitation hardenable martensitic stainless steels were produced, having the chemical compositions shown in Table 1 and the values in the equations of (a) to (d) (referred to "defined value" in Table 1).

Note the thermal treatment was conducted for the precipitation hardenable martensitic stainless steels in the same conditions as in Examples.

For these precipitation hardenable martensitic stainless steels, the items of the δ-ferrite and residual austenite, the tensile strength, the Charpy value, and the pitting potential were evaluated in the same way as in Examples together with the total evaluation. The evaluation results were summarized in Table 2.

Reference Examples 1 to 4

The stainless steels in Reference Examples 1 to 4 correspond to the 12 Cr steel described in Japanese Laid-Open Patent Publication No. 2000-161006 or one of the precipitation hardenable martensitic stainless steels described in Japanese Laid-Open Patent Publication Nos. 2005-194626, 2005-232575, and 2008-127613. The chemical compositions and the values in the equations of (a) to (d) were summarized in Table 1.

The 12 Cr steel in Reference Example 1 was obtained by conducting the following thermal treatment. In the thermal treatment, a solution treatment (quench treatment) was conducted, in which a sample material in Reference Example 1 (see Table 1) was heated at 1150° C. for 1.0 hr using a box furnace, and was rapidly cooled by immersing the material in oil at room temperature. Then, a primary tempering treatment was conducted, in which the sample material was heated at 560° C. for 1.0 hr, and was gradually cooled in the air at room temperature. Subsequently, a secondary tempering treatment was conducted, in which the sample material was heated at 620° C. for 1.0 hr, and was gradually cooled in the air at room temperature.

The precipitation hardenable martensitic stainless steel in Reference Example 2 was obtained by conducting the following thermal treatment. In the thermal treatment, a solution treatment (quench treatment) was conducted, in which a sample material in Reference Example 2 (see Table 1) was heated at 925° C. for 1.0 hr using a box furnace, and was gradually cooled in the air at room temperature. Then, an aging treatment was conducted, in which the sample material was heated at 540° C. for 4.0 hr, and was gradually cooled in the air at room temperature.

The precipitation hardenable martensitic stainless steel in Reference Example 3 was obtained by conducting the following thermal treatment. In the thermal treatment, a solution treatment (quench treatment) was conducted, in which a sample material in Reference Example 3 (see Table 1) was heated at 1000° C. for 1.0 hr using a box furnace, and was gradually cooled in the air at room temperature. Then, an aging treatment was conducted, in which the sample material was heated at 575° C. for 4.0 hr, and was gradually cooled in the air at room temperature.

The precipitation hardenable martensitic stainless steel in Reference Example 4 was obtained by conducting the following thermal treatment. In the thermal treatment, a solution treatment (quench treatment) was conducted, in which a sample material in Reference Example 4 (see Table 1) was heated at 1030° C. for 2.0 hr using a box furnace, and was forcedly and rapidly cooled by a blower. Then, an aging treatment was conducted, in which the sample material was heated at 566° C. for 4.0 hr, and was gradually cooled in the air at room temperature.

For these precipitation hardenable martensitic stainless steels, the items of the δ-ferrite and residual austenite, the tensile strength, the Charpy value, and the pitting potential were evaluated in the same way as in Examples together with the total evaluation. The results were summarized in Table 2.

(Comparison of Stainless Steels among Examples, Comparative Examples, and Reference Examples)

As shown in Table 2, in the precipitation hardenable martensitic stainless steels in Examples 1-5, no δ-ferrite and no residual austenite were observed in the metallic structure and all the metallic structure became the tempered martensite. Further, every evaluation item as mentioned above satisfied the target value. Hereby, it is determined that the precipitation hardenable martensitic stainless steel of the present invention has the high strength, high toughness and high corrosion resistance properties.

In contrast, as shown in Table 1, in Comparative Example 1, the value of (a) was smaller than the defined value and the value of (b) in Comparative Example 3 was smaller than the defined value. Accordingly, in these Comparative Examples, the precipitation amount of the carbide or the inter-metallic compound was not sufficient, whereby the tensile strength did not satisfy the target value as shown in Table 2.

Further, as shown in Table 1, in Comparative Example 2, the value of (a) was larger than the defined value and the value of (b) in Comparative Example 4 was larger than the defined value. Accordingly, in these Comparative Examples, too much amount of the carbide or the inter-metallic compound was precipitated, whereby the Charpy value did not attain the target value, resulting in significantly poor hot forging property as shown in Table 2.

Further, as shown in Table 1, in Comparative Example 5, the value of (c) was larger than the defined value and the value of (d) in Comparative Example 6 was larger than the defined value. Accordingly, in these Comparative Examples, the δ-ferrite or the residual austenite was precipitated in 1.0% or more, whereby the structure stability did not satisfy the target value as shown in Table 2.

Further, as shown in Table 1, in Comparative Example 7, the content of Cr was lower than the predetermined range, and the pitting potential was decreased thereby not to satisfy the target value as shown in Table 2. Moreover, the tensile strength was also decreased thereby not to satisfy the target value.

Further, as shown in Table 1, in Comparative Example 8, the content of Mo was lower than the predetermined range, and the tensile strength and the pitting potential were significantly decreased, thereby not to satisfy the target values as shown in Table 2.

Further, as shown in Table 1, in Comparative Example 9, the content of Mo was larger than the predetermined range and the δ-ferrite was precipitated as shown in Table 2, resulting in the poor structural stability.

As shown in Table 2, in Reference Example 1, the pitting potential did not attain 220 mV, thereby not to satisfy the target value of the corrosion resistance.

Further, as shown in Table 2, in Reference Example 2, the pitting potential was lower than 220 mV, thereby not to attain the target value.

Further, as shown in Table 2, in Reference Example 3, the tensile strength did not attain the target value.

Further, as shown in Table 2, in Reference Example 4, the tensile strength and the pitting potential did not attain the target values, respectively.

Example 6

In Example 6, a steam turbine blade was produced using the precipitation hardenable martensitic stainless steel in Example 5.

First, a vacuum carbon deoxidation was conducted for molten steel which was prepared so as to have the chemical composition and the defined value in Example 5. Herein, in the vacuum carbon deoxidation, the deoxidation was conducted through the chemical reaction represented as "C+0 CO", under the high vacuum condition at the pressure below $5.0\times10^{-3}$ Pa. Next, the deoxidation product was molded as an electrode, immersed in the molten slag, and melted by the self heating of the Joule heat generated when the current flowed. The resulting molten product was solidified in the water cooling mold, thereby to obtain a so called electro slag remelting steel lump with a high quality. Then, using the steel lump, a steam turbine blade was molded through the hot forging.

Next, a refining treatment was conducted for the molded steam turbine blade. The refining treatment was conducted as follows. A solution treatment (or quench treatment) was conducted, in which the steam turbine blade was heated at 930° C. for 1.5 hr, and then rapidly cooled by immersing the blade in water at room temperature. Then, a primary tempering treatment was conducted, in which the steam turbine blade was heated at 560° C. for 3.0 hr, and then gradually cooled in the air at room temperature. Finally, a secondary tempering treatment was conducted, in which the steam turbine blade was heated at 580° C. for 3.0 hr, and then gradually cooled in the air at room temperature.

Next, for the steam turbine blade after conducting the refining treatment, surface grinding and deformation removing treatments or the like were conducted, to produce the steam turbine blade (or the final stage blade of the low pressure steam turbine) of the present invention.

The steam turbine blade obtained in the Example 6, was similarly evaluated as in Example 1. The result of the microstructure analysis showed that the structure of the steam turbine blade was the tempered martensite, and no δ-ferrite and no residual austenite were observed. Further, in the evaluation test, all the items of the tensile strength at room temperature, the Charpy value at room temperature and the pitting potential satisfied the target values.

What is claimed is:

1. A precipitation hardenable martensitic stainless steel containing at a mass rate, C: 0.05-0.10%, Cr: 12.0-13.0%, Ni:

6.0-7.0%, Mo: 1.0-2.0%, Si: 0.01-0.05%, Mn: 0.06-1.0%, Nb: 0.3-0.5%, V: 0.3-0.5%, Ti: 1.5-2.5%, Al: 1.0-2.3%, and the remainder consisting of Fe and an unavoidable impurity, wherein the precipitation hardenable martensitic stainless steel satisfies all conditions that a value of (a) defined in the equation below is in the range of 1.1 to 1.8, a value of (b) is in the range of 8.5 to 11.8, a value of (c) is 20.2 or less, and a value of (d) is 10.0 or less $$(a)=[Nb\ \%]+[V\ \%]+10\times[C\ \%]$$

$$(b)=[Al\ \%]+[Ni\ \%]+[Ti\ \%]$$

$$(c)=[Cr\ \%]+1.5\times[Si\ \%]+[Mo\ \%]+0.5\times[Nb\ \%]+2\times[Ti\ \%]$$

$$(d)=[Ni\ \%]+0.5\times[Mn\ \%]+30\times[C\ \%].$$

2. A steam turbine blade formed by a precipitation hardenable martensitic stainless steel containing at a mass rate, C: 0.05-0.10%, Cr: 12.0-13.0%, Ni: 6.0-7.0%, Mo: 1.0-2.0%, Si: 0.01-0.05%, Mn: 0.06-1.0%, Nb: 0.3-0.5%, V: 0.3-0.5%, Ti: 1.5-2.5%, Al: 1.0-2.3%, and the remainder consisting of Fe and an unavoidable impurity, wherein the precipitation hardenable martensitic stainless steel satisfies all conditions that a value of (a) defined in the equation below is in the range of 1.1 to 1.8, a value of (b) is in the range of 8.5 to 11.8, a value of (c) is 20.2 or less, and a value of (d) is 10.0 or less, $$(a)=[Nb\ \%]+[V\ \%]+10\times[C\ \%]$$

$$(b)=[Al\ \%]+[Ni\ \%]+[Ti\ \%]$$

$$(c)=[Cr\ \%]+1.5\times[Si\ \%]+[Mo\ \%]+0.5\times[Nb\ \%]+2\times[Ti\ \%]$$

$$(d)=[Ni\ \%]+0.5\times[Mn\ \%]+30\times[C\ \%].$$

3. The steam turbine blade according to claim 2, wherein the steam turbine blade is a final stage blade of a low pressure steam turbine.

4. The steam turbine blade according to claim 3, wherein a length of the steam turbine blade is 45 inch (1.14 m) or more for a rotational speed of 3600 rpm and the length of the steam turbine blade is 50 inch (1.27 m) or more for a rotational speed of 3000 rpm.

* * * * *